United States Patent [19]

Rolek

[11] Patent Number: 4,852,303

[45] Date of Patent: Aug. 1, 1989

[54] REFRIGERATOR DOOR FRAME WITH INSULATED MULLION

[75] Inventor: Matthew Rolek, Chicago, Ill.

[73] Assignee: Ardco, Inc., Chicago, Ill.

[21] Appl. No.: 131,182

[22] Filed: Dec. 10, 1987

[51] Int. Cl.[4] ..... E06B 1/32

[52] U.S. Cl. ..... 49/504; 49/478; 62/248

[58] Field of Search ..... 62/248, 219, 275; 49/504, 478, DIG. 1, 365, 381

[56] References Cited

U.S. PATENT DOCUMENTS

| | | | |
|---|---|---|---|
| 3,263,063 | 7/1966 | Marriott et al. | 62/248 X |
| 3,612,821 | 10/1971 | Stranquist | 62/248 X |
| 3,673,735 | 7/1972 | Winsler et al. | 49/478 X |
| 4,004,370 | 1/1977 | Heaney | 49/504 X |
| 4,330,310 | 5/1982 | Tates, Jr. et al. | 62/275 |
| 4,588,235 | 5/1986 | Barroero | 49/504 X |
| 4,676,026 | 6/1987 | Schreiner | 49/504 |

*Primary Examiner*—James R. Brittain

*Attorney, Agent, or Firm*—Dennis R. Schlemmer

[57] ABSTRACT

A refrigerator door assembly having a door mounting frame with at least one mullion that includes a metallic structural frame member and a magnetically attractable sealing plate mounted forwardly on the mullion for defining a stop and sealing surface for the swinging ends of pivotably mounted doors. The mullion includes an insulating and sealing plate retaining assembly which supports the sealing plate in thermally isolated relation to the structural member and which defines an air insulating space completely about the structural frame member. The illustrated insulating and sealing plate retaining assembly includes a plastic channel shaped member having a front wall disposed in closely adjacent relation to a front side of the structural frame member and side walls extending in rearwardly directed fashion therefrom. A cover plate is releasably engagable with the rearwardly extending side walls for completely encapsulating the structural frame member. The magnetically attractable sealing plate is supported by the channel shaped plastic member in forwardly spaced relation to the structural frame member. Various metallic accessory items are supportable on the mullion in substantially thermally isolated relation to the structural frame member.

22 Claims, 2 Drawing Sheets

REFRIGERATOR DOOR FRAME WITH INSULATED MULLION

DESCRIPTION OF THE INVENTION

The present invention relates generally to door assemblies for commercial refrigerators and freezers, and more particularly, to an improved more thermally efficient mullion for the door mounting frame of such door assemblies.

Insulated glass door assemblies, such as used in commercial refrigerators and freezers in supermarkets and the like, generally comprise a plurality of insulated glass doors mounted for swinging movement in a door mounting frame, which in turn is mounted within the opening of a wall of a refrigerator cabinet or the like. The door mounting frame extends about the periphery of the opening in the cabinet wall and includes one or more mullions that extend vertically between the top and bottom perimeters of the frame to provide rigidity for the frame and a sealing surface against which the swinging sides of the doors engage when closed.

Because the insulated doors usually comprise a plurality of glass panes, they are relatively heavy and require a sturdy and rugged frame for supporting their weight and for withstanding abusive repeated opening and closing that occurs in commercial establishments. The mullions, therefore, typically include a metal structural frame member, such as an aluminum extrusion, which is highly heat conductive. Moreover, in order to provide a magnetically attractive sealing surface against which a door mounted magnetic gasket is engagable for establishing reliable sealing contact, it is common to affix a metal sealing plate to the front of the mullion.

For ensuring reliable contact of the magnetic gasket with the sealing strip, notwithstanding adjustable mounting of the door in the frame, the sealing strip typically is sized larger than the magnetic gasket, and indeed, generally extends completely across the width of the mullion so that it serves as a sealing surface for doors mounted on both sides thereof. As a result, even when the doors are in their closed positions, the metal sealing plate on the mullion often extends between the ambient air and refrigerated sides of the sealing gasket. If preventative measures are not taken, portions of the sealing plate exposed to the ambient air for prolonged periods will cool below the dew point temperature of the ambient air, resulting in the formation of frost on the surface of the sealing plate. Further frosting problems result when metal accessories, such as lock plates, lighting fixtures, or the like are affixed to the mullion. In an effort to prevent such frost buildup, it has been the practice to electrically heat the metal frame and sealing plate so as to maintain exposed portions of the sealing plate and accessories above the dew point temperature of the ambient air. Such electrical heating can significantly increase the operating cost of the refrigerator or freezer unit.

It is an object of the present invention to provide an improved, more thermally efficient mullion for the door mounting frame of commercial refrigerator and freezer door assemblies. A related object is to provide a such mullion that has relatively high strength and rigidity and is adapted for condensation-free use in commercial refrigerator and freezer units with reduced electrical heating requirements.

Another object is to provide mullion as characterized above which includes a metallic structural member and a magnetically attractive sealing plate mounted in thermally isolated relation to the structural member.

A further object is to provide a mullion of the above kind that includes sealing plate mounting means which encapsulates the structural frame member and more effectively thermally insulates the sealing plate from the refrigerated zone.

Yet another object is to provide a mullion of the foregoing type which is of relatively simple construction and lends itself to economical manufacture.

Still a further object is provide such a mullion which permits secure mounting of metallic accessories, such as door lock plates, lighting fixtures, and the like, in substantially thermally isolated relation to the metallic frame of the mullion.

Other objects and advantages of the invention will become apparent upon reading the following detailed description and upon reference to the drawings, in which.

Figure 1:
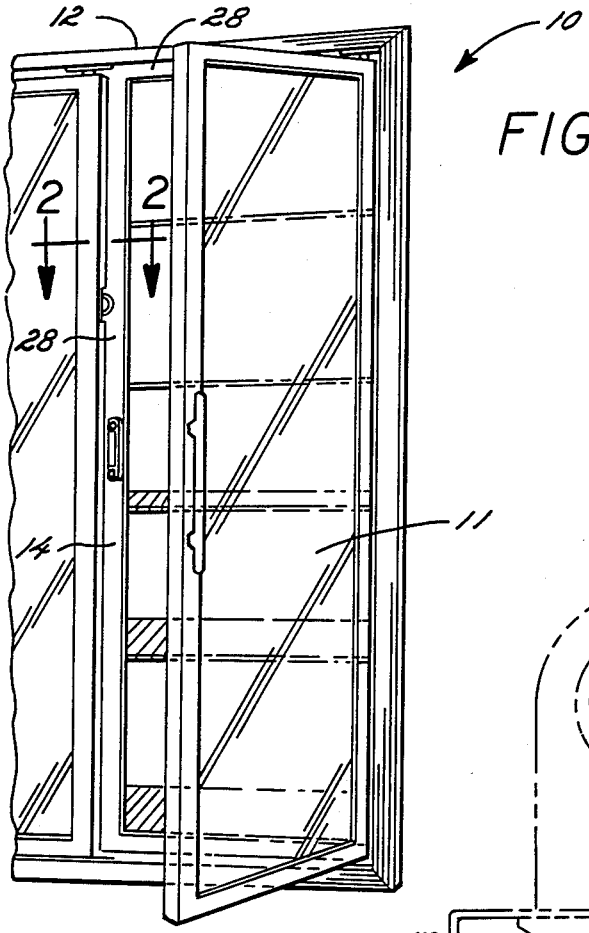
FIG. 1 is perspective of a refrigerator door assembly having a door mounting frame with a mullion in accordance with the present invention.

While the invention is susceptible of various modifications and alternative constructions, a certain illustrated embodiment thereof has been shown in the drawings and will be described below in detail. It should be understood, however, that there s no intention to limit the invention to the specific form disclosed, but on the contrary, the intention is to cover all modifications, alternative constructions and equivalents falling within the spirit and scope of the invention.

Referring now more particularly to FIGS. 1–4 of the drawings, there is show an illustrative refrigerator door assembly 10 comprising a plurality of insulted glass doors 11 mounted for swinging movement in a door mounting frame 12, which in turn typically is mounted within the opening of a front wall of a refrigerator cabinet or the like. It will be understood that he door assembly 10 is particularly adapted for use in free standing refrigerator or freezer cases or built-in coolers or cabinets of the type used in supermarkets and other retail stores to display refrigerated or frozen merchandise. The door mounting frame 12 extends about the periphery of the opening in the wall and includes one or more mullions 14 that extend vertically between the top and bottom perimeters of the frame to provide rigidity for the frame 12 and define a sealing surface against which the free swinging sides of the doors 11 engage when in a closed condition.

The insulated glass doors 11 in this case each include an insulated glass unit 15 (FIG. 2), which may be of a known type comprising a plurality of glass panes disposed in parallel side by side relation with a tubular spacer positioned in sealed relation about the perimeter. The glass unit 15 in this instance is supported within an outer metal frame member 18, which preferably is an aluminum extrusion, the frame member 18 defining a rewardly opening channel 19 and having a front leg 20 positioned in adjacent relation to a front side of the glass unit 15. A separate retaining member 21 is releasably engagable in the channel 19 of the frame member 18 for retaining a rear side of the glass unit. A plastic or other non-metallic, resilient sealing member 22 is interposed between the leg 20 of the frame member 18 and the glass unit 15 to provide a seal about the forward peripheral edge of the glass unit.

Figure 2:
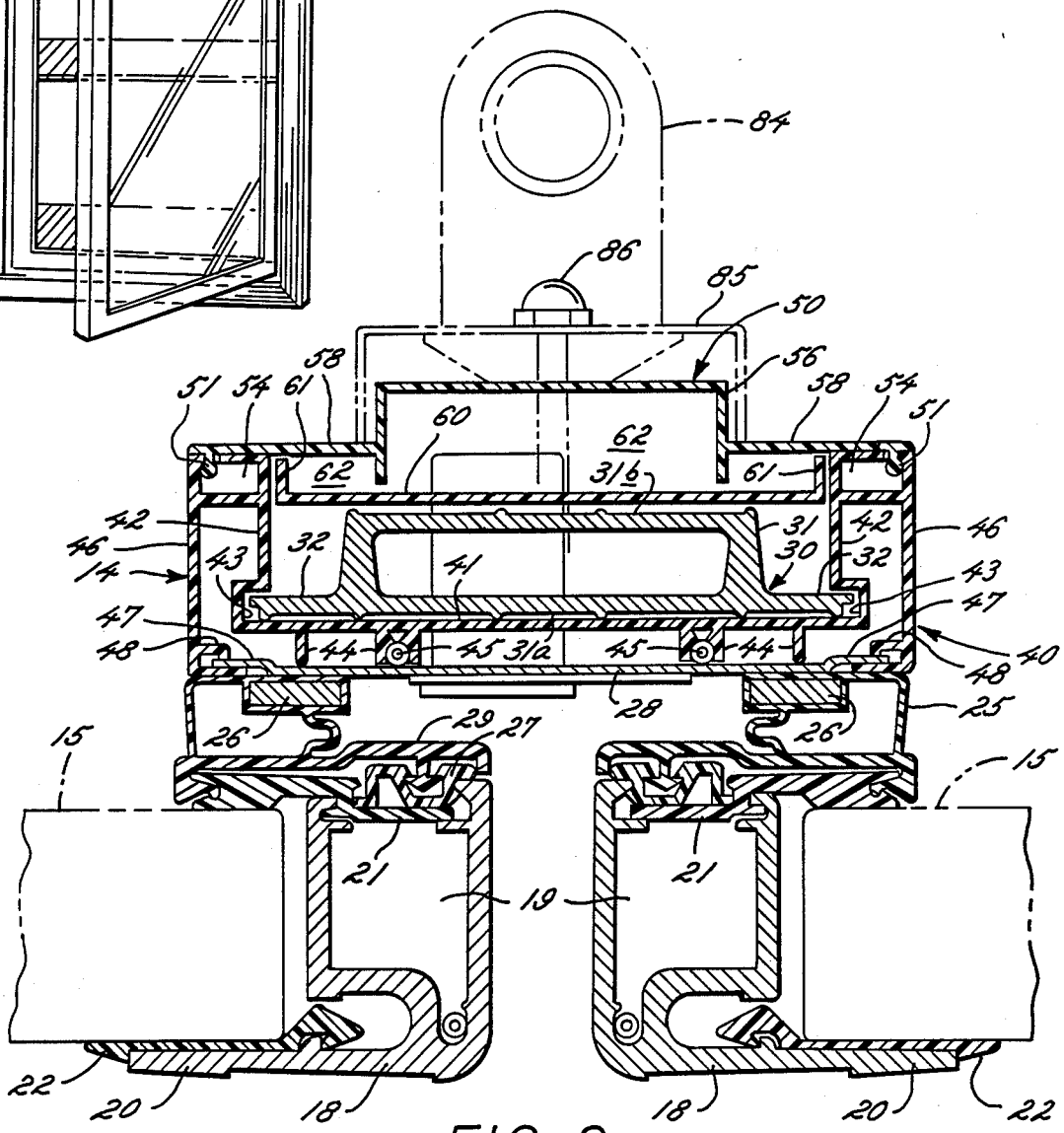
FIG. 2 is enlarged fragmentary section taken in the plane of line 2—2 in FIG. 1, showing the mullion of the present invention with the free swinging sides of a pair of doors on opposed sides thereof in their closed position.
Figure 3:
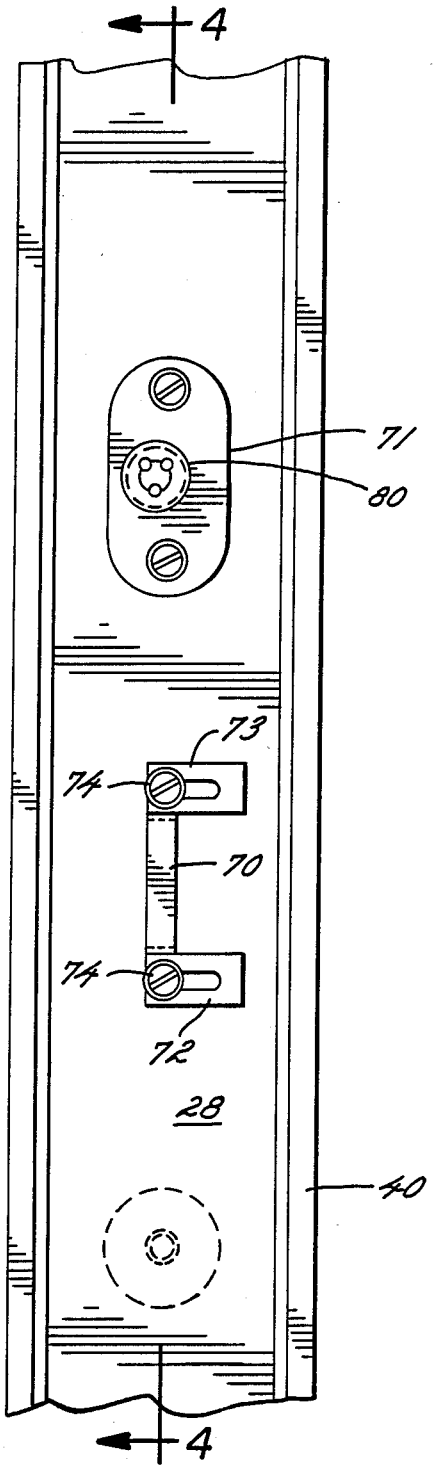
FIG. 3 is an enlarge partial plan view of a front of the illustrated mullion, showing accessories mounted thereon.
Figure 4:
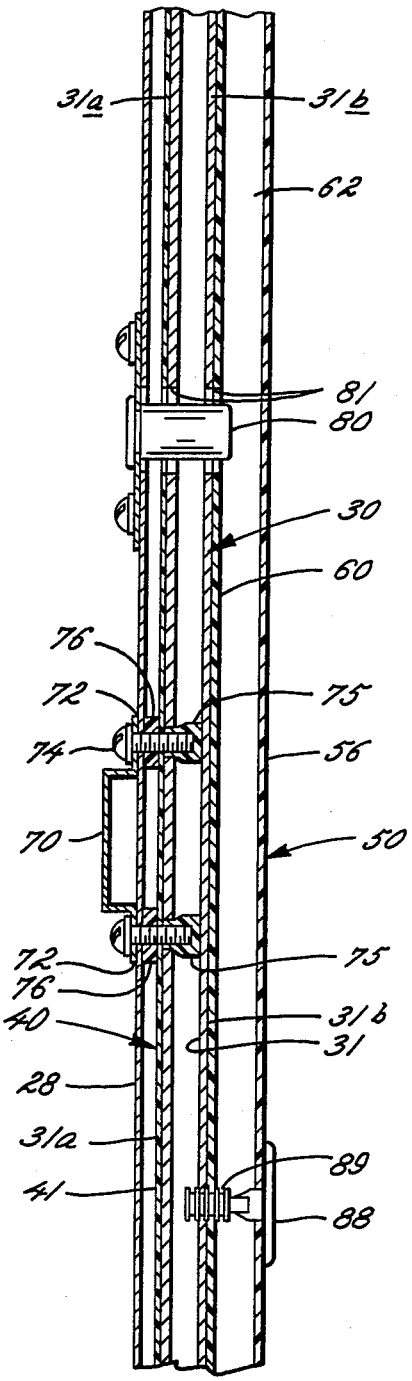
FIG 4 is a fragmentary vertical section of the illustrated mullion, taken in the plane of line 4-4 in FIG. 3.

For providing a seal between the door 11 and the cabinet frame 12 when the door is in a closed position so as to prevent the entry of warm air from the ambient air side into the refrigerated zone, a gasket 25 is secured to the rear side of each door 11. The gasket 25 contains magnets 26 for creating a magnetic attraction with a metallic sealing plate or strip 28, preferably made of a metallic or vinyl clad material, mounted on the frame 12 about the perifery of the door opening for defining a sealing and stop surface for the doors. The gasket 25 in this case is affixed to a carrying plate 27 that is adapted for snap action engagement with the retaining member 21. Typical of the prior art, the sealing plate 28 on the front of the mullion 17 extends across substantially the width of the mullion 14 so as to provide a sealing surface for doors on both sides thereof, as shown in FIG. 2. Because the sealing plate 28 is highly heat conductive and extends across the ambient air and refrigerated sides of a door mounted gasket engaged therewith, heretofore it has been susceptible to frost buildup.

In accordance with the invention, each mullion includes a rigid metallic structural frame member and means for supporting the magnetically attractive sealing plate on the structural frame member in the thermally isolated relation thereto for enhancing the thermal operating efficiency of the mullion. To this end, the mullion 14 includes a structural frame member 30 which preferably is made of aluminum or other high strength metal and has an elongated hollow section 31 with outwardly extending flanges 32 on opposite sides thereof The hollow section 31 in this instance is generally rectangular in configuration with the long sides of the rectangle defining forward and rear faces 31*a*, 31*b*, respectively, of the frame member. The flanges 32 extend outwardly from the hollow section 31 with forward faces thereof in substantial co-planer relation to the forward face 31*b* of the frame member 30. The hollow configuration of the structural frame member 30 has been found to enhance the strength and rigidity of the mullion, while the air space defined within the hollow section 31 tends to insulate the forward and rear faces 31*a*, *l* 31*b* from each other, and thus, enhance the thermal efficiency.

For supporting the sealing plate in thermally isolated relation to the metallic structural frame member, a non-metallic, generally channel-shaped insulating and retaining member 40 is disposed about a front face of the structural frame member 30 for supporting the sealing plate 28 in forwardly spaced relation to the frame member with an air insulating space therebetween. The insulating and retaining member 40, which may be made of PVC or other substantially rigid plastic material, has a generally C-shaped configuration with a front wall 41 that is substantially co-extensive with the front of the structural frame member 30 and first or inner side walls 42 that extend rearwardly beyond the plane of the rear face 31*b* of the structural frame member 30. The inner side walls 42 in this instance are laterally spaced from each other slightly less than the distance between the outer edges of the flanges 32 of the structural frame member 30 and are formed with a pair of inwardly opening channels 43 shown in FIG. 2 adjacent their forward ends for captively receiving the opposed edges of the flanges 32. The front wall 41 of the insulating and retaining member 40 has a plurality of forwardly extending ribs 44 that support the sealing plate 28 in spaced relation to the front wall 41 of the insulating or retaining member 40 and define a plurality of air spaces therebetween. The ribs 44 further define longitudinally extending grooves within which one or more electrical heating wires 45 may be positioned and retained. In the illustrated embodiment, electrical heating wires 45 are disposed in grooves defined by the ribs 44 at positions adjacent to where the outer peripheral edge of the door mounted sealing gasket 25 engages the sealing plate so as to ensure that the portion of the sealing plate exposed to ambient air for prolonged periods when the doors are closed remain above the dew point temperature of the ambient air.

For positively engaging and retaining the opposed sides of the sealing plate 28, the insulating and retaining member 40 is formed with second or outer side walls 46 that are coupled to the inner side walls 42 at locations adjacent their rearward ends so as to permit limited pivotal movement of the forward ends thereof. The forward ends of the outer side walls 46 are formed with opposed inwardly directed channels 48 that can be forced outwardly with the side walls 46, by virtue of the inherent resiliency of the plastic material from which the insulating and retaining member is formed, to permit insertion of peripheral sides 47 of the sealing plate 28 into the channels 48. Upon release, the sides 46 snap back to their original position with the channels 48 captively engaging the opposed peripheral sides 47 of the sealing plate 28. Alternatively, it will be understood that the sealing plate 28 could be assembled into the insulating and retaining member 40 simply by telescopically positioning the sealing plate into the channels 48 of the side walls 46. The peripheral sides 47 of the sealing plate 28 in this case are recessed inwardly slightly such that the front sealing surface defined by the sealing plate 28 is in substantially the same plane as the forward sides of the channels 48.

For enclosing the rear side of the structural frame member and creating an air insulating zone adjacent thereto, a non-metallic closure member 50, again preferably made of substantially rigid PVC plastic material, is releasably engagable with the rear of the retaining and insulating member 40. The illustrated closure plate 50 is formed with forwardly facing mounting ribs 51, which in this instance have enlarged generally cylindrical terminal ends. For releasably receiving the closure plate mounting ribs 51, the rear terminal ends of the inner and outer side walls 42, 46 of the retaining and insulating member 40 define channels 54 with a relatively narrow width entry opening, corresponding substantially to the thickness of the walls of the closure plate mounting ribs 51, but slightly less than the diameter of the cylindrical terminal ends thereof. The terminal ends of the mounting ribs 51 may be forced through the openings and into the channels 54, with the closure plate thereby being positively retained in mounted position.

The illustrated closure plate 50 has a rearwardly extending central section 56 adapted to facilitate mounting of accessories, as will become apparent. The rearwardly extending central section 56 has forwardly directed walls 59 for stabilizing the cover plate 50 and maintaining the proper spaced relation of the cover plate 50 with respect to the structural frame member 30. In this instance, a separate inner plastic, insulating plate 60 is interposed between the cover plate 50 and the structural frame member 30, which together with the cover plate, defines an air insulating space 62 adjacent the rear side of the structural frame member 30. The insulating plate 60 includes rearwardly directed flanges 61 for enhancing the rigidity of the assembly. It will be understood that the closure plate 50 and further insulating plate 60 could be formed as a single member.

It will be seen from the foregoing that the nonmetallic insulating and sealing plate retaining assembly, comprising the plastic retaining member 40, cover plate 50, and insulating plate 60, not only maintains the sealing plate 28 in thermally insulated relation to the metallic structural member 30, but defines an air insulating space which completely surrounds the structural frame member 30. The hollow configuration of the structural frame member 30 further enhances the thermal efficiency of the mullion. Hence, while the magnetically attractive sealing plate 28 extends completely across the front of the mullion, the portions of the sealing plate 28 that are exposed to ambient air for prolonged periods may be maintained above the dew point temperature of the ambient air with relatively minimal electrical heating requirements as compared to conventional mullion designs.

In keeping with the invention, the mullion 14 is adapted for supporting commonly used accessories in substantially thermally insulated relation from the metallic structural frame member 30. In the illustrated embodiment, a lock strike plate 70 and an electrical inlet 71 are supported on a central forwardly facing side of the sealing plate 28. The lock strike plate 70 is a conventional metal stamped part having a generally C-shaped configuration with opposed flanges 72 for mounting on the sealing plate 28. For securing the lock strike plate 70 in thermally isolated relation to the structural frame member 30, fastening screws 74 each are engagable in a plastic insert 75 disposed between the sealing plate 28 and the structural frame member 30. The insert 75 is expandable upon threaded engagement by the fastener 74 for positively retaining the fastener in its engaged position. The insert 75 also encapsulates the rearwardly extending end of the fastener 74 to insulate it from the structural frame member 30. A plastic spacer 76 preferably also is interposed between the sealing plate 28 and the front wall 41 of the insulating and retaining member 40 for maintaining proper spacing.

The electrical outlet 71, which may be of a known type such as shown in U.S. Pat. No. 4,578,902 assigned to the same assignee as the present application, may similarly be mounted in thermally insulated relation to the structural frame member 30. A rearwardly extending cylindrical body portion 80 of the electrical outlet 71 in this instance extends through oversized apertures 81 in the structural frame member 30 so as to ensure that no metal-to-metal contact exists.

Accessories also may be mounted on the rear of the mullion, again in substantially thermally insulated relation to the structural frame member. In the illustrated embodiment, a vertically extending light fixture 84 having a mounting channel 85, which may be made of metal, is supported over the rearwardly extending central section 56 of the cover plate 50 (FIG. 2). Mounting studs 86 extend through the mounting channel 85 and cover plate 50, and preferably are affixed to the structural frame member 30 to ensure secure mounting engagement. Appropriate insulating means, such as plastic sleeves, again may be utilized for insulating the mounting bolts 86 from the structural frame member 30. For maintaining the cover plate 50 in securely mounted relation on the structural frame member 30, a plurality of retaining members 88 (FIG. 4) having plastic Christmas type inserts 89 are positionable through respective mounting apertures in the structural frame member.

From the foregoing, it can be seen that the mullion of the present invention has relatively high strength and rigidity while being adapted for condensation free use in commercial refrigerator and freezer units with minimal electrical heating requirements. The non-metallic sealing plate mounting assembly not only securely supports the vinyl clad sealing plate in thermally isulated relation to the metallic structural frame member of the mullion, it further defines an insulating air space that completely surrounds the structural frame member. Yet, the mullion has a relatively simple contruction which lends itself to economical manufacture.

I claim as my invention:

1. A refrigerator door assembly mountable within the opening in the wall of a refrigerated cabinet at its front comprising a door mounting frame having an outer peripheral portion mountable within said cabinet opening, a plurality of insulated doors mounted for pivotal movement on said frame, said doors each having sealing gasket means adjacent an outer peripheral side thereof, said frame including at least one mullion spanning between top and bottom sides of said frame with the outer periphery thereof being remote from said cabinet wall for establishing a stop for a pair of doors when said doors are in a closed condition, said mullion including a metallic structural frame member having an elongated cross sectional configuration with a long side thereof facing the front of said cabinet, a sealing plate mounted forwardly of said structural frame member for engagement by the gasket means of said pairs of doors when in a closed condition, insulating and retaining means for supporting said sealing plate in parallel spaced-apart, thermally isolated relation to a front side of said structural frame member with an air insulating space between said sealing plate and said structural frame member, and said insulating and retaining means includes means defining first plastic non-metallic walls which encompass the outer periphery of said structural frame member and means defining second plastic non-metallic walls which together with said first walls define an air insulating space about a rear and opposite lateral sides of said structural frame member.

2. The refrigerator door assembly of claim 1 in which said first plastic non-metallic wall include a front wall adjacent a front side of said structural frame member and said second plastic non-metallic walls include side walls spaced outwardly from opposed lateral sides of said structural frame member.

3. The refrigerator door assembly of claim 2 in which said side walls include means for releasably engaging and supporting said sealing plate in outwardly spaced relation to said front wall.

4. The refrigerator door assembly of claim 2 in which said side walls are formed with opposing channel shaped terminal ends for captively receiving opposed lateral sides of said sealing plate.

5. The refrigerator door assembly of claim 2 in which the front wall of said insulating and retaining means includes forwardly directed ribs which support said sealing plate in spaced relation to said structural frame member and which define at least one electrical heating wire retention slot, and an electrical heating wire disposed in said retention slot in closely adjacent relation to a rear side of said sealing plate.

6. The refrigerator door assembly of claim I including metallic accessory means mounted on said sealing plate in thermally isolated relation to said structural frame member.

7. The refrigerator door assembly of claim 6 in which said accessory means include a metallic lock strike plate.

8. The refrigerator door assembly of claim 6 in which said accessory means includes an electrical outlet.

9. The refrigerator door assembly of claim 1 in which aid sealing plate is made of magnetically attractable material.

10. A refrigerator door assembly mountable within the opening in the wall of a refrigerator cabinet comprising a door mounting frame having an outer peripheral portion mountable within said cabinet opening, a plurality of insulated doors mounted for pivotal movement on said frame, said doors each having sealing gasket means adjacent an outer peripheral side thereof, said frame including at least one mullion extending between top and bottom sides thereof and against which said doors close, said mullion including a metallic structural frame member and a sealing plate supported forwardly thereof for engagement by the gasket means of said doors when in a closed condition, non-metallic insulating and retaining means for encapsulating said structural frame member, supporting said sealing plate in spaced apart thermally insulated relation to said structural frame member, and defining insulating air spaces on forward and rearward sides thereof, said insulating and retaining means including a channel shaped member having a front wall disposed in closely adjacent relation to a front side of said structural frame member and rearwardly directed side walls, and a cover plate releasably engagable with said rearwardly extending side walls for closing the rear side of said channel member.

11. A refrigerator door assembly mountable within the opening in the wall of a refrigerated cabinet comprising a door mounted frame having an outer peripheral portion mountable within said cabinet opening, a plurality of insulated doors mounted for pivotal movement on said frame, said doors each having sealing gasket means adjacent an outer peripheral side thereof, said frame including at least one mullion extending between top and bottom sides thereof and against which said doors close, said mullion including a metallic structural frame member and a sealing plate supported forwardly thereof for engagement by the gasket means of said doors when in a closed condition, non-metallic insulating and retaining means for encapsulating said structural frame member, supporting said sealing plate in spaced apart thermally isolated relation to said structural frame member, and defining insulating air spaced on forward and rearward sides of said structural frame member, said insulating and retaining means including means defining a front wall adjacent a front side of said structural frame member and means defining side walls adjacent opposed lateral sides of said structural frame member, said side wall being formed with opposing channels for captively receiving opposed lateral sides of said sealing plate, said insulating and retaining means further including a cover plate enclosing a rear side of said structural frame member, and said side walls of said insulating and retaining means including means at the rearward terminal ends thereof for releasably engaging said cover plate and supporting said cover plate in outwardly spaced relation to the rear of said structural frame member.

12. The refrigerator door assembly of claim 11, in which said side walls of said insulating and retaining member include first side walls extending rearwardly of said front wall at locations closely adjacent the opposed lateral sides of said structural frame member and second side walls disposed in outwardly spaced relation to said first side walls for defining air insulating spaces adjacent said lateral sides of said structural frame member.

13. The refrigerator door assembly of claim 12 in which said front wall and first side walls of said retaining and insulating means defines channels for receiving lateral sides of said structural frame member.

14. The refrigerator door assembly of claim 13 in which said sealing plate retaining channels of said insulating and retaining member are formed at the forward terminal ends of said second side walls.

15. The refrigerator door assembly of claim 14 in which said rearward terminal ends of said first and second side walls define rearwardly directed retention slots, and said cover plate being formed with forwardly directed ribs adjacent lateral sides thereof for releasably engaging in said retention slots.

16. The refrigerator door assembly of claim 15 including a further insulating plate interposed between a rear side of said structural frame member and said cover plate.

17. The refrigerator door assembly of claim 11 in which said cover plate includes a central rearwardly extending portion which defines a relatively deep air insulating space about a rear side of said structural frame member, and outwardly extending wall portions on opposed sizes of said central portion which define relatively shorter depth air insulating spaces adjacent the rear side of said frame member.

18. The refrigerator door assembly of claim 11 including a vertically extending light mounted on said cover plate rearwardly of said mullion.

19. The refrigerator door assembly of claim 18 in which said cover plate includes a rearwardly extending central portion, and said vertical light fixture includes a channel shaped mounting bracket positionable over said rearwardly extending central cover plate portion.

20. A refrigerator door assembly mountable within the opening in the wall of a refrigerator cabinet comprising a door mounting frame having an outer peripheral portion mountable within said cabinet opening.

a plurality of insulated doors mounted for pivotal movement on said frame, said doors each having sealing gasket means adjacent an outer peripheral side thereof, said frame including at least one mullion extending between top and bottom sides thereof and against which said doors close, said mullion including a metallic structural frame member having a central hollow portion which defines a central air insulating space and outwardly extending flanges on opposed sides thereof.

a sealing plate mounted forwardly of said structural frame member for engagement by the gasket means of said doors when in a closed condition, insulating and retaining means for supporting said sealing plate in parallel spaced-apart, thermally isolated relation to a front side of said structural frame member, said insulating and retaining means including non-metallic means for encapsulating said structural frame member and defining insulating air spaces on forward and rearward sides thereof, and said non-metallic means being formed with a pair of opposing channels for receiving opposed sides of said flanges.

21. The refrigerator door assembly of claim 20 in which said structural frame member hollow portion has an elongated cross sectional configuration with one long side thereof defining a front face of said structural frame member and a second long side defining a rear face of said structural frame member.

22. The refrigerator door assembly of claim 21 in which said outwardly extending flanges of said structural frame member extend outwardly from said hollow section with front sides thereof in substantially coplanar relation to said front face of said structural frame member.

* * * * *